US012043933B2

(12) United States Patent
Ugnon-Coussioz et al.

(10) Patent No.: US 12,043,933 B2
(45) Date of Patent: Jul. 23, 2024

(54) SYSTEM FOR BONDING LAYERS COMPRISING FIBERS TO FORM A NONWOVEN WEB

(71) Applicant: ANDRITZ KUESTERS GMBH, Krefeld (DE)

(72) Inventors: Jean-Michel Ugnon-Coussioz, Barraux (FR); Dennis Latendorf, Krefeld (DE)

(73) Assignee: ANDRITZ KUESTERS GMBH, Krefeld (DE)

( * ) Notice: Subject to any disclaimer, the term of this patent is extended or adjusted under 35 U.S.C. 154(b) by 119 days.

(21) Appl. No.: 17/702,816

(22) Filed: Mar. 24, 2022

(65) Prior Publication Data

US 2022/0307176 A1 Sep. 29, 2022

(30) Foreign Application Priority Data

Mar. 29, 2021 (DE) ..... 10 2021 107 900.4

(51) Int. Cl.
*D04H 5/02* (2012.01)
*D04H 5/03* (2012.01)
*D04H 5/08* (2012.01)

(52) U.S. Cl.
CPC ..... *D04H 5/02* (2013.01); *D04H 5/03* (2013.01); *D04H 5/08* (2013.01)

(58) Field of Classification Search
CPC .. D04H 5/03; D04H 5/02; D04H 5/08; D04H 1/492; D04H 1/498; D04H 1/49;
(Continued)

(56) References Cited

U.S. PATENT DOCUMENTS 6,381,817 B1 5/2002 Moody, III
6,750,166 B1 6/2004 Etzold et al.
(Continued)

FOREIGN PATENT DOCUMENTS

CN 1708612 A 12/2005
CN 1954109 A 4/2007
(Continued)

OTHER PUBLICATIONS

S.J. Russel: "The Textile Institute: Handbook of nonwovens", CRC Press/Woodhead Publishing Ltd., pp. 80-81 (2007).

*Primary Examiner* — Amy Vanatta
(74) *Attorney, Agent, or Firm* — Norman B. Thot

(57) ABSTRACT

A system for bonding a first layer having short fibers with a second layer having long fibers into a nonwoven web. The system includes a belt, a headbox, a depositing belt with a delivery strand, a transfer belt with a receiving strand, a device, a pre-bonding unit, and a bonding device. The short fibers are deposited on the depositing belt to form the first layer with the headbox. The transfer belt transfers the first layer to the second layer. The pre-bonding unit has spaced-apart compacting devices which act on the transfer belt to form a lower strand of the transfer belt there between. The bonding device is arranged between the compacting devices. The bonding device bonds the first and second layers. The compacting devices and the bonding device are operatively connected to one another so that they are each always either in an operating state or in a resting state.

18 Claims, 7 Drawing Sheets

(58) Field of Classification Search
CPC ..... D04H 1/465; D04H 18/04; D04H 5/00; D04H 3/11; D04H 1/495; D04H 1/732; D04H 1/74; D04H 1/70; D04H 1/46; D04H 1/736; D04H 5/06; D21F 2/00; D21F 7/00; D21F 9/00
See application file for complete search history.

(56) References Cited

U.S. PATENT DOCUMENTS

| | | | | |
|---|---|---|---|---|
| 7,278,187 | B2 * | 10/2007 | Petersen | D04H 1/593 19/302 |
| 10,718,076 | B2 * | 7/2020 | Weigert | D04H 1/498 |
| 2001/0027594 | A1 * | 10/2001 | Fleissner | D04H 18/04 28/107 |
| 2002/0157766 | A1 | 10/2002 | Vuillaume et al. | |
| 2002/0168910 | A1 * | 11/2002 | Vuillaume | D04H 3/153 442/385 |
| 2003/0024092 | A1 | 2/2003 | Orlandi | |
| 2003/0217448 | A1 * | 11/2003 | Andersen | D04H 1/732 28/104 |
| 2005/0091811 | A1 * | 5/2005 | Billgren | D04H 5/02 28/104 |
| 2006/0230589 | A1 * | 10/2006 | Christensen | D04H 1/492 28/117 |
| 2007/0000107 | A1 | 1/2007 | Jeambar | |
| 2007/0067973 | A1 | 3/2007 | Conner | |
| 2008/0045107 | A1 | 2/2008 | Michalon et al. | |
| 2012/0096694 | A1 | 4/2012 | Muenstermainn | |
| 2018/0002866 | A1 | 1/2018 | Latendorf et al. | |
| 2018/0112339 | A1 | 4/2018 | Weigert et al. | |

FOREIGN PATENT DOCUMENTS

| | | | | |
|---|---|---|---|---|
| CN | 101589186 | A | 11/2009 | |
| CN | 102388173 | A | 3/2012 | |
| CN | 107429485 | A | 12/2017 | |
| DE | 198 27 567 | A1 | 12/1999 | |
| DE | 600 30 120 TA | | 2/2007 | |
| DE | 60 2004 008 578 | T2 | 5/2008 | |
| DE | 10 2008 008 549 | A1 | 9/2008 | |
| DE | 102008031278 | A1 * | 1/2009 | D04H 1/46 |
| DE | 10 2009 017 729 | A1 | 10/2010 | |
| DE | 10 2013 107 237 | A1 | 1/2015 | |
| DE | 102015106490 | B3 * | 9/2016 | D04H 1/495 |
| EP | 1 126 064 | B1 | 12/2003 | |
| EP | 3 118 361 | A1 | 12/2003 | |
| EP | 1 929 080 | B1 | 4/2009 | |
| EP | 2 096 207 | A1 | 9/2009 | |
| EP | 3 283 679 | B1 | 11/2020 | |
| GB | 1 474 120 | A | 5/1977 | |
| WO | WO 01/63032 | A1 | 8/2001 | |
| WO | WO 02/077348 | A1 | 10/2002 | |
| WO | WO 2004/063451 | A1 | 7/2004 | |
| WO | WO 2004/097097 | A1 | 11/2004 | |
| WO | WO 2005/118934 | A1 | 12/2005 | |
| WO | WO 2008/074665 | A1 | 6/2008 | |
| WO | WO 2008/110134 | A1 | 9/2008 | |
| WO | WO-2009112015 | A1 * | 9/2009 | D04H 1/48 |
| WO | WO 2015/000685 | A1 | 1/2015 | |
| WO | WO 2015/049018 | A1 | 4/2015 | |
| WO | WO 2016/165798 | A1 | 10/2016 | |

* cited by examiner

SYSTEM FOR BONDING LAYERS COMPRISING FIBERS TO FORM A NONWOVEN WEB

CROSS REFERENCE TO PRIOR APPLICATIONS

Priority is claimed to German Patent Application No. DE 10 2021 107 900.4, filed Mar. 29, 2021. The entire disclosure of said application is incorporated by reference herein.

FIELD

The present invention relates to a system for bonding a layer comprising short fibers with a layer comprising long fibers to form a nonwoven web, the system comprising a first circulating belt on which the layer comprising long fibers can be deposited and displaced in a direction of production, a circulating depositing belt on which the short fibers can be deposited by means of a headbox to form the layer and which has a delivery strand, a revolving transfer belt with a receiving strand, via which the layer comprising short fibers can be transferred to the layer comprising long fibers at a transfer point, and a device which is actively connected to the delivery strand or, for example, to the receiving strand, via which the delivery strand and the receiving strand can be displaced between a transfer position, in which at least a substantial proportion of the fibers is transferred from the delivery strand to the receiving strand and conveyed on by the transfer belt, and a rest position, in which the delivery strand and receiving strand are spaced from each other and at least a significant proportion of the fibers is not transferred to the receiving strand but is conveyed on by the depositing belt.

BACKGROUND

A system for producing a nonwoven web having a device with a continuously circulating depositing belt has previously been described in EP 3 283 679 B 1. The fibers are here continuously deposited on the depositing belt, for example, in the form of an aqueous emulsion. The device is arranged so that the layer of fibers is deposited from the depositing belt at a transfer point onto the top of a second fiber layer that runs in the direction of production and is fed to production steps for forming a nonwoven web, such as compaction and bonding steps.

The provision of the layer of fibers by such a device can be problematic if the device must be stopped, for example, because a switch must be made to another layer to which the layer of fibers is to be delivered from the transfer point. This is the case because, due to their construction, it is not possible to temporarily interrupt the depositing process in the prior art headboxes. If the circulation of the depositing belt were stopped at the transfer point to interrupt the delivery of the fiber layer, this would result in an undesirably large quantity of fibers being deposited on the depositing belt in the region of the headbox, which would lead to problems when restarting the system and at least result in defective areas in the nonwoven web to be produced.

Systems of this type can have a further disadvantage when they are started up. Because the depositing process is to take place on a layer containing long fibers which are to be fed on a conveyor, the fibers are regularly first deposited on the conveyor because the layer has not yet been conveyed to the transfer point. Alternatively, the conveying of the layer may also already have progressed so far at the beginning of the deposit that a length portion without the deposited fibers may result. Undesired waste is produced in both cases.

In addition to the depositing belt, the prior art also provides for a circulating transfer belt with a receiving strand, via which the layer comprising short fibers can be transferred to the layer comprising long fibers at a transfer point, a device that is operatively connected to the delivery strand or, for example, to the receiving strand, via which the delivery strand and the receiving strand can be displaced between a transfer position, in which at least a significant proportion of the fibers are transferred from the delivery strand to the receiving strand and conveyed on by the transfer belt, and a rest position, in which the delivery strand and receiving strand are spaced from each other and at least a significant proportion of the fibers is not transferred to the receiving strand and is conveyed on by the depositing belt in order to be able to cause or interrupt the transfer of the layer comprising short fibers to the layer comprising long fibers without the headbox having to be interrupted for this purpose.

SUMMARY

An aspect of the present invention is to further develop a system with the features referenced above so that it is particularly well suited for the production of a nonwoven web in which a layer comprising light short fibers, e.g., with a basis weight between 5 and 50 grams per square meter, e.g., a light and wet wood fiber layer, is applied to and bonded to a layer comprising long fibers which can have, for example, a basis weight of between 15 and 50 grams per square meter. This production regularly causes difficulties since carded layers comprising long fibers often have elastic properties and show recovery effects after compaction, which can result in deformations, defects and even cracks in the wood fiber layer. The nonwoven web produced can have a basis weight of between 20 and 150 grams, for example, between 40 and 70 grams per square meter.

In an embodiment, the present invention provides a system for bonding a first layer comprising short fibers with a second layer comprising long fibers to form a nonwoven web. The system includes a circulating belt which is configured to have the second layer comprising the long fibers be placed and displaced thereon in a direction of production, a headbox, a circulating depositing belt comprising a delivery strand, a circulating transfer belt comprising a receiving strand, a device, a pre-bonding unit, and a bonding device. The circulating depositing belt is configured to have the short fibers be deposited thereon so that, together with the headbox, the first layer is formed. The circulating transfer belt is configured so that the first layer comprising the short fibers can be transferred at a transfer point to the second layer comprising the long fibers. The device is operatively connected to the delivery strand or to the receiving strand so that the delivery strand or the receiving strand are displaced between a transfer position, in which at least a substantial proportion of the short fibers are transferred from the delivery strand to the receiving strand and conveyed onward by the circulating transfer belt, and a rest position of the short fibers, in which the delivery strand and the receiving strand are spaced apart and at least the substantial proportion of the short fibers is not transferred to the receiving strand, but is conveyed on by the circulating delivery belt. The pre-bonding unit comprises a first compacting device and a second compacting device which are spaced apart from one another in the direction of production. The first compacting device and the second compacting device are configured to act on the circulating transfer belt in a region so as to form a lower strand of the circulating transfer belt between the first compacting device and the second compacting device. The bonding device is arranged between first compacting device and the second compacting device in the direction of production. The bonding device is configured to bond the first layer and the second layer together by swirling the short fibers and the long fibers. The first compacting device, the second compacting device and the bonding device are operatively connected to one another so that they are each always either in an operating state or in a resting state.

BRIEF DESCRIPTION OF THE DRAWINGS

The present invention is described in greater detail below on the basis of embodiments and of the drawings in which.

DETAILED DESCRIPTION

Figures 1, 1A:
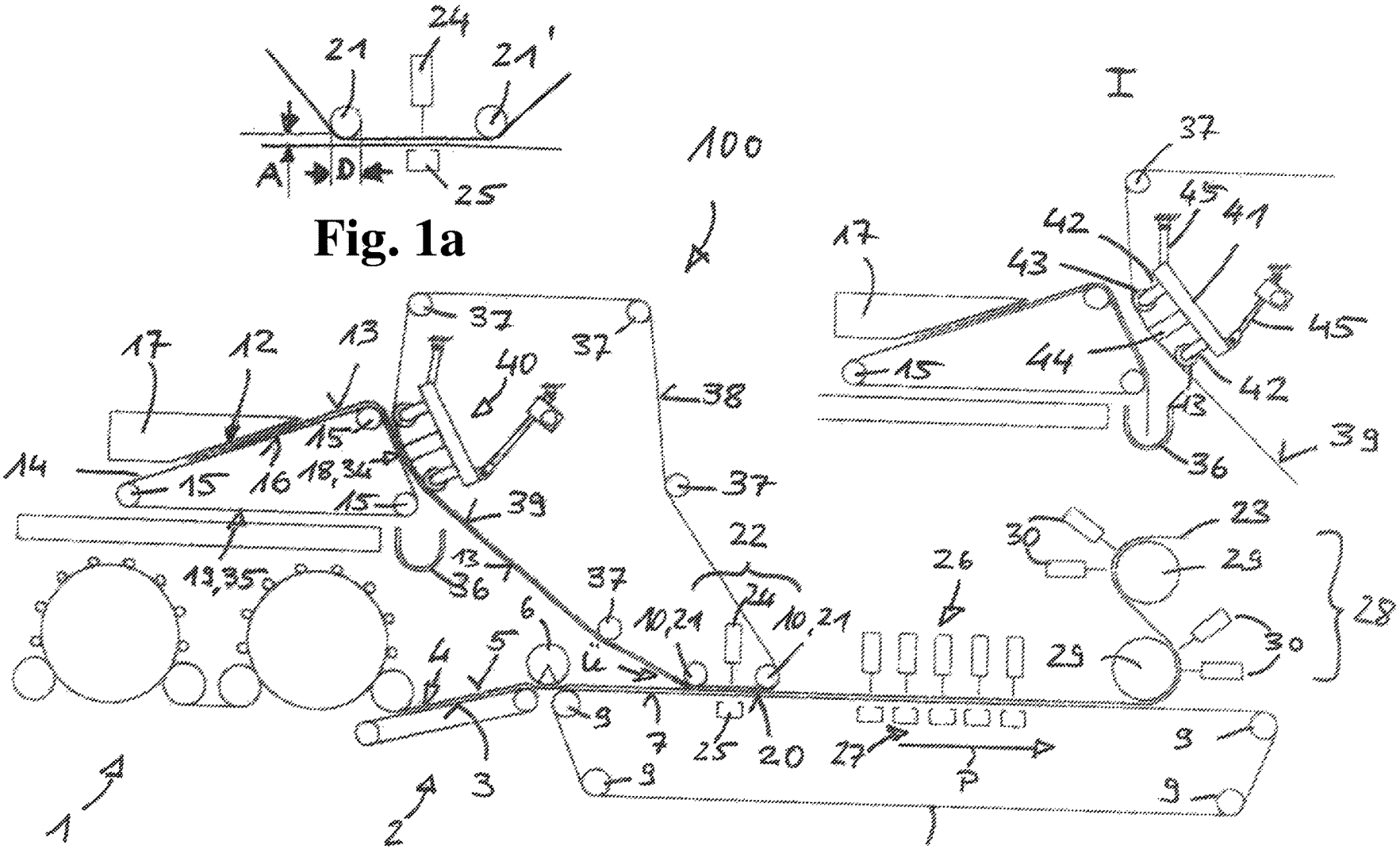
FIG. 1 is a first embodiment in the transfer position and partially in the rest position.
FIG. 1*a* shows a detail of FIG. 1 on a slightly larger scale.

The system according to the present invention comprises a pre-bonding unit comprising two compacting devices which are spaced apart from one another in the direction of production and which act on the transfer belt in a given region and form a lower strand of the transfer belt between them.

The pre-bonding unit comprises two compacting devices that are spaced apart from one another in the direction of production. With these two compacting devices, a distance between the transfer belt and the first belt, which can, for example, run parallel thereto, can be reduced in one region to a value that is smaller than the sum of the thicknesses of the two layers, as a result of which the two layers are separated due to a compressive force acting thereon across a region in which they are compactable. The two belts can also contact each other in this region which means that the distance can assume the value zero if no layer passes through the pre-bonding unit. When passing through one or more layers, the belts can again assume a distance in this region due to the flexibility of at least one of the belts without a displacement of the pre-bonding unit being absolutely necessary for this purpose.

The two compacting devices can both act on one and the same of the first and the second belt, or one of the two compactors acts on one belt, and the other of the two compactors acts on the other belt.

The pre-bonding unit also comprises a bonding device arranged between the compacting devices, in particular a waterjet compacting device, via which the two layers can be bonded by swirling the fibers together. The compacting device can, for example, be designed so that the fibers are not swirled across the entire region in which the compaction takes place as well, but only in a partial region, in particular in a linear manner, via a nozzle bar extending transversely to the direction of production.

According to the present invention, the compacting device and the bonding device are also integrated into the system so that they are always both in the operating state or in the idle state. The devices can, for example, always be in the operating state when the layer comprising short fibers is transferred by the depositing belt.

Due to the arrangement of the bonding device between the compacting devices and the associated simultaneous bonding due to the compaction, a recovery of the layer comprising long fibers is avoided so that the use of the system according to the present invention or the application of the method according to the present invention substantially reduces the risk of defectively formed nonwoven webs with two layers.

A first embodiment of a system according to the present invention comprises a pre-bonding unit in which the compacting devices each comprise a pressure roller.

It has, however, been found that the production costs of a system according to the present invention can be reduced without restricting its functionality if, as in a second embodiment, the compacting devices of the pre-bonding unit each comprise a pressure bar.

The compacting devices of the pre-bonding unit can be arranged so that, in the operating state, they come in contact with the first belt and, for example, move the first belt parallel to the second belt in the region in which the pre-bonding unit has its effect.

If the first compacting device in the direction of production is a pressure roller, then the second belt can, for example, be guided so that the distance between the line extending transversely to the direction of production, along which the second belt first touches the outer circumference of the pressure roller, to the upper side of the first belt corresponds at least to the thickness of the fiber layers. This distance is typically 15 mm, 20 mm or more. An undesirable compacting of the layers before the transfer point is avoided due to this configuration.

In an embodiment of the present invention, when viewed in the direction of production in front of the pre-bonding unit and/or viewed in the direction of production behind the pre-bonding unit, lower rollers circulated by the second belt can, for example, be arranged. The guidance of the second belt is thereby improved, which can in turn improve the pre-bonding process that can be achieved with the system according to the present invention.

In an embodiment of the present invention, the lower rollers can, for example, be arranged so that the transfer belt to the first belt between the lower rollers and the compacting devices adjacent thereto have an entry angle $\alpha$ between 1° and 10° and an exit angle $\alpha'$ of greater than 1°. It has been shown that a particularly good result can be achieved with the pre-bonding unit with an entry angle in this size range but that the size of the exit angle is of less importance for the result.

In an embodiment of the present invention, the first compacting device, when viewed in the direction of the production, acts from above against the lower strand of the transfer belt and the second compacting device, when viewed in the direction of production, acts from below against the upper strand of the first circulating belt.

The first circulating belt thereby experiences a change in direction when passing the second compacting device. This change can, for example, be at least 1°. It has surprisingly been shown that this reduces the undesired tendency of the pre-bonded layers to adhere to the transfer belt.

In an embodiment of the present invention, the first compacting device can, for example, comprise a first lower pressure roller.

In a second embodiment of the present invention, the second compacting device can, for example, comprise a suction chamber. The tendency of the pre-bonded layers to stick to the transfer belt is in this case again substantially reduced.

The suction chamber can, for example, comprise at least one contact surface for the first circulating belt, and furthermore, for example, a suction opening.

In an embodiment of the present invention, the second compacting device can, for example, comprise a pressure roller which can be designed in a manner that is identical to the first lower pressure roller.

A suction chamber is in this case, for example, provided in the direction of production, for example, directly behind the pressure roller. The pressure roller is alternatively designed as a suction roller, via which an air flow can be generated by the first circulating belt.

The water-jet bonding device can, for example, be designed as a nozzle bar which is connected to a pressure source, via which water can be supplied at a pressure that can be up to 100 bar but is usually significantly lower, for example, a maximum of 30 bar or lower, depending on the pre-bonding requirements that are determined by the properties of the short and long fibers. The nozzle bar can, for example, emit jets of water with diameters typically ranging from 80 to 180 microns.

The nozzle bar can, for example, be arranged within the transfer belt and can, for example, have the same distance from the compacting units when viewed in the direction of production.

If the device with which the delivery strand and receiving strand is, for example, arranged between the transfer position and the rest position within the transfer belt, the space requirement of the device according to the present invention can be reduced. The space around the depositing belt is then available for further machine components, such as suction devices for sucking off process water.

In an embodiment of the system according to the present invention, the device can, for example, comprise a first guide which comes in contact with or can be brought into contact with the transfer belt in the region of the receiving strand and which can be displaced with a movement component perpendicular to the receiving strand. In order to bring the receiving strand into the transfer position, it is in that case necessary to move the first guide in the direction of the receiving strand. In the transfer position, the first guide therefore inevitably comes in contact with the transfer belt. In order to move the receiving strand into the rest position, the first guide must then be moved in the opposite direction, which means that it is possible, but not necessary, for the first guide to come in contact with the transfer belt in the rest position.

The transfer belt can, for example, be designed to be at least gas permeable. "At least gas permeable" means that an additionally water-permeable design of the transfer belt can be desirable, for example, if the transfer belt must be penetrable by water jets for the purpose of detaching and/or bonding the layer of fibers.

The transfer belt must be gas permeable in particular when the device, for example, comprises a suction device that can be activated as desired and that sucks from the transfer belt in the region of the receiving strand. The process of transferring the layer of fibers can thereby be supported when the delivery and receiving strands are in the transfer position, since the layer of fibers is sucked in by the transfer belt due to the air flow caused by the suction device.

A further development of the device according to the present invention is an embodiment in which the device comprises a guide which comes in contact with or which can be brought into contact with the transfer belt in the region of the receiving strand, which can be displaced with a movement component perpendicular to the receiving strand, and which is spaced apart from the transfer belt in the circumferential direction. This makes it possible to move the transfer belt over a greater length relative to the delivery strand of the depositing belt and also to adapt the directions in which the delivery strand and the receiving strand extend relative to one another within the meaning of an adaptation to an optimal transfer of the layer of fibers.

It has been found that when a second guide is present, that the suction device can, for example, be arranged between the first and the second guide in the circumferential direction of the transfer belt.

The device is particularly suitable for displacing the receiving strand relative to the delivery strand when it comprises a support structure which is arranged so that it can be moved and/or pivoted by a motor parallel to the receiving strand.

If a fiber-collecting device is, for example, provided, almost all of the fibers discharged from the headbox reach the fiber-collecting device when the delivery and receiving strands are in the rest position, in which no fibers or the layer formed by them is transferred to the transfer belt. The fiber-collecting device can in this case, for example, be designed so that the collected fibers can be returned to the manufacturing process. A particular advantage of providing the fiber-collecting device is that the system according to the present invention can comprise a device for reducing the width of the layer comprising the short fibers by cutting off one or both border regions of the layer, particularly in the region of the device with which the delivery strand and the receiving strand can be displaced between the transfer position and the rest position, and the severed border regions or the short fibers forming them are collected by the collecting device.

If the delivery strand of the depositing belt runs, for example, in the circumferential direction and is delimited by a deflection roller, via which the depositing belt is deflected by a deflection angle into a return strand, the collecting device can, for example, be arranged below the deflection roller.

In order to reduce the proportion of fibers adhering to the return strand, the deflection angle can, for example, be greater than 90°.

If the system according to the present invention comprises, for example, a carding unit for providing the layer comprising the long fibers, the carding unit can be provided inline. If layers of different widths comprising long fibers are, fore example, provided by the carding unit, the device for reducing the width of the layer comprising short fibers is then used to set the width thereof so that it is at most as wide as the layer comprising long fibers. Short fibers are thereby prevented from adhering to the first circulating belt.

The present invention will be explained in greater detail below based on the drawings which show, in a purely schematic manner, various embodiments of a system for the production of a nonwoven web.

The system shown in FIG. 1 for producing a nonwoven web 23, which in particular can have a basis weight between 20 and 150 grams per square centimeter, in particular between 40 and 70 grams per square centimeter, comprises a first embodiment of a device (device 100) for providing a layer 13 of fibers 12, in particular short fibers 12 with an average length of between 1 mm and 10 mm and, for example, a basis weight of between 5 and 50 grams per square meter, the structure and function of which is described in detail below.

The system also includes a carding unit 1 with which a layer 5 of long fibers 4, in particular having a length of between 10 mm and 150 mm and, for example, a basis weight of between 15 and 50 grams per square centimeter, can be produced.

The carding unit 1 comprises a circulating depositing belt 2 with an upper strand 3 on which the long fibers 4 can be deposited to form the layer 13.

The system also includes a suction roller 6 with which the layer 5 can be transferred to an upper strand 7 of a first belt 8 circulating around rollers 9 in a clockwise direction. The upper strand 7 moves in the direction of the arrow drawn in the figures, which thus symbolizes the direction of production P.

The first circulating belt 8 is designed to be permeable to liquids and gases, for example, as a screen belt.

The device 100 for providing the layer 13 of short fibers 12 comprises a depositing belt 14 which runs around rollers 15 in a clockwise direction.

The depositing belt 14 is in turn designed to be permeable to liquids and gases, for example, as a screen belt. Due to the arrangement of the rollers 15, the depositing belt 14 forms a region 16 that ascends, when viewed in the direction of rotation, and in which the short fibers 12 are deposited from a headbox 17, for example, as an aqueous emulsion, to form the layer 13.

The depositing belt 14 also includes a region 18 which slopes obliquely downward in the direction of rotation and which forms a delivery strand 34. The depositing belt 14 is guided over a subsequent roller 15 in a horizontal region 19 which forms a return strand 35.

A fiber-collecting device 36 is arranged below the roller 15 on which the delivery strand 34 merges into the return strand 35.

The device 100 also comprises a transfer belt 38 which runs counterclockwise around upper rollers 37 and lower rollers 21 and which has a receiving strand 39. A device 40 is provided within the space delimited by the transfer belt 38 with which the receiving strand 39 is moved between a transfer position in which a portion of the receiving strand 39 is at least almost in contact with the delivery strand 34 of the depositing belt 14 and at least a substantial proportion of the short fibers 12 of the layer 13 is transferred from the delivery strand 34 to the receiving strand 39, and a rest position in which the receiving strand 39 is spaced from the delivery strand 34 and at least a substantial proportion of the fibers is not transferred to the receiving strand. In FIG. 1, the rest position is illustrated in detail I.

The device 40 comprises a support structure 41 on which two guides 42 are arranged which are spaced apart from one another in relation to the direction of rotation of the transfer belt 38. Each guide 42 includes a roller 43 which comes in contact with the receiving strand 39 of the transfer belt 38 from the inside. As seen in the direction of rotation of the transfer belt 38, a selectively activatable suction device 44 is arranged between the guides 42 via which air can be sucked through the transfer belt 38, thereby making it possible to suction the short fibers 12 or the layer 13 onto the transfer belt 38.

The support structure 41 is linked to a machine frame (which is not shown in the drawing) via linkage units 45, at least one of which is variable in length, so that the device 40 can be displaced between a position at which the transfer belt 38 is in the transfer position and a position at which the transfer belt 38 is in the rest position.

As can be seen in detail I, the short fibers 12 forming the layer 13 are not transferred to the transfer belt 38 in the rest position, but instead pass from the delivery strand 34 of the depositing belt 14 to the fiber-collecting device 36.

If the receiving strand 39 is in the transfer position, the short fibers 12, by coming into contact with the receiving strand 39, reach the transfer belt 38, if necessary, supported by the action of the suction device 44. From the transfer belt 38, the short fibers 12 or the layer 13 reach a lower strand 20 of the transfer belt 38 which is formed between the lower rollers 21.

In the system shown in FIG. 1, the lower rollers 21, 21' form the compacting devices 10, 10' and are part of a pre-bonding unit 22. During the operation of the system, they are in a position relative to the upper strand 7 of the first circulating belt 8 in which the distance between the lower strand 20 of the depositing belt 14 and the upper strand 7 of the first circulating belt 8 is smaller than the sum of the thicknesses of layers 5 and 13. The two belts 8 and 14 can also come in contact with each other in this region; in other words, the distance can assume the value zero if no layer passes through the pre-bonding unit 22. When passing through one or more layers, the belts 8 and 14 can assume a distance again due to the flexibility of the first circulating belt 8 without a displacement of the pre-bonding unit 22 being absolutely necessary for this purpose.

As illustrated in FIG. 1*a*, at least the first lower roller 21 in the direction of production has a diameter D which is greater than or equal to one twentieth of the length of the printing roller transverse to the direction of production P. The guidance of the second belt is selected so that the line extending transversely to the direction of production, along which the second belt first touches the outer circumference of the lower roller 21, has a distance A.

The layer 13 is transferred to the layer 5 due to the arrangement of the rollers 15 and the lower rollers 21 at a transfer point Ü which, when seen in the direction of production P, is located in front of the lower roller 21 shown on the left in the drawing. Since the distance between the upper strand 7 and the lower strand 20 is smaller than the sum of the thicknesses of the two layers 5 and 13, the two layers experience a first areal compaction in the process of becoming a nonwoven web 23 when they pass through the region between the two lower rollers 21. The size of the region depends on the distance between the two lower rollers 21 in the direction of production P.

To provide that the desired compaction can take place, the first circulating belt 8 and the depositing belt 14 must rotate at identical speeds so that there is no friction during compaction which could adversely affect the compaction process.

To ensure that the two layers 5, 13 have sufficient strength after leaving the region between the upper strand 7 and the lower strand 20 for the further processing steps necessary to form the nonwoven web, the pre-bonding unit 22 comprises a clamping unit in the direction of production P between the two lower rollers 21 and within the nozzle bar 24 arranged on the depositing belt 14, which forms a bonding device, and a collecting device 25, which is arranged at a corresponding point in the direction of production within the first circulating belt 8, which can comprise a suction box. On its side facing the lower strand 20, the nozzle bar 24 comprises a plurality of nozzles from which jets of water exit under pressure during the operation of the system 1, causing the two layers 5 and 13 to bond as they are swirled by the lower strand 20 of the depositing belt 14. The collecting device 25 is used to collect at least part of the water discharged from the nozzle bar 24, which can then be returned to the production process, possibly after treatment.

Due to the arrangement of the bonding device between the compacting devices and the associated simultaneous bonding due to the compaction, a recovery of the layer comprising long fibers 4 is avoided so that the use of the system according to the present invention or the application of the method according to the present invention substantially reduces the risk of defectively formed nonwoven webs with two layers.

For further bonding and compaction purposes, a plurality of nozzle bars 26 and collecting devices 27 are provided outside of the depositing belt 14 in order to additionally bond the layers 5 and 13 from above.

A further bonding device 28 is provided downstream in the direction of production P. It comprises two bonding drums 29 which, during operation, are rotated by the layers 5 and 13 so that each of the two layers is in contact with one of the two bonding drums 29 over an angular range of approximately 120°. Two additional nozzle bars 30 are provided for each bonding drum 29 and act in a region in which the layers 5, 13 are in contact with the bonding drums 29.

The bonding drums 29 each have a gas- and liquid-permeable lateral surface so that at least part of the water discharged from the nozzle bars 30 during operation can be suctioned by the bonding drums 29 and also, possibly after treatment, can be returned to the production process. The bonding device 28 is used for further bonding of the two layers 5 and 13 to form the nonwoven web 23, which can be fed to further processing steps after having passed through the bonding device.

Figure 2:
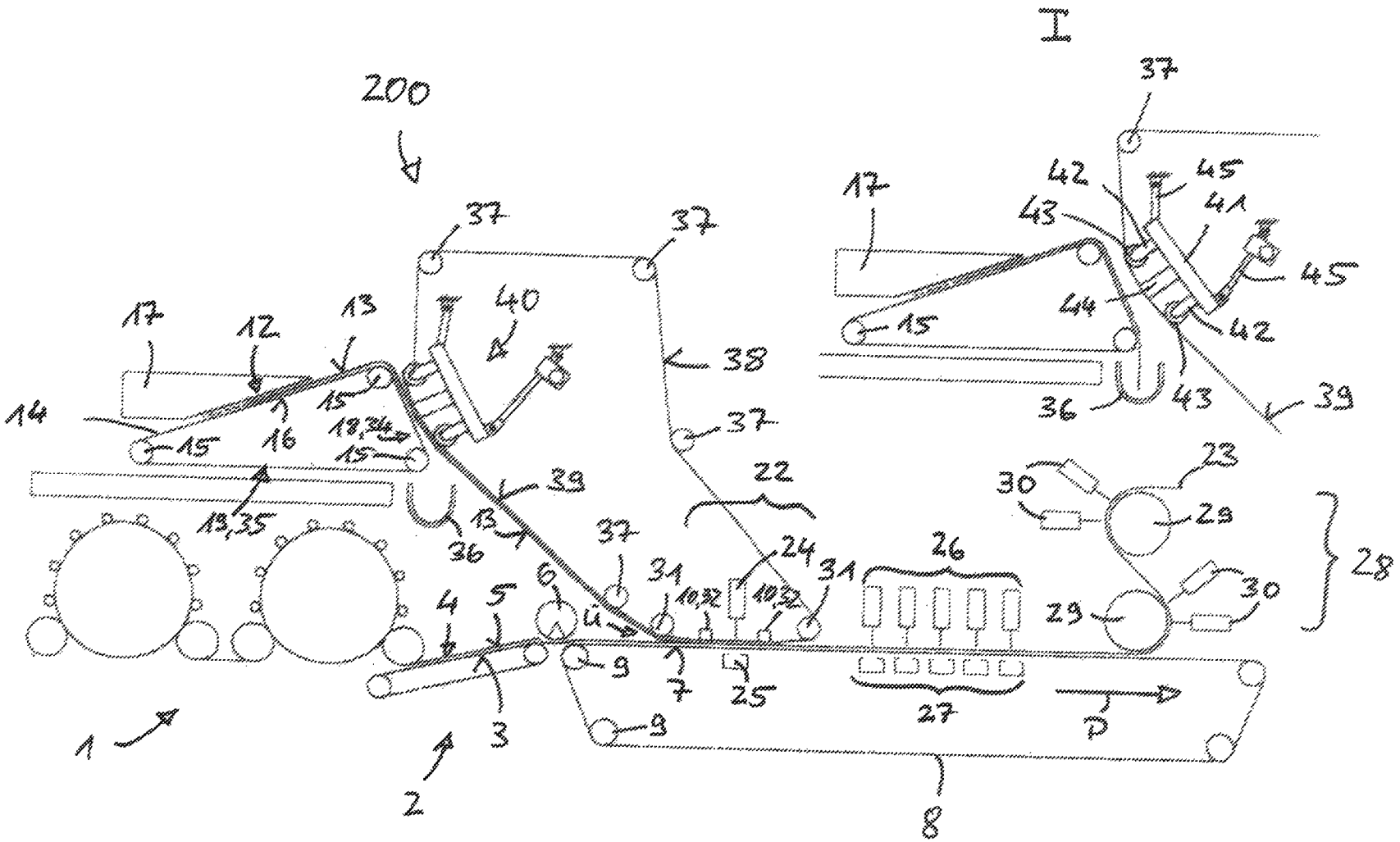
FIG. 2 is a second embodiment in the transfer position and partially in the rest position.
Figure 3:
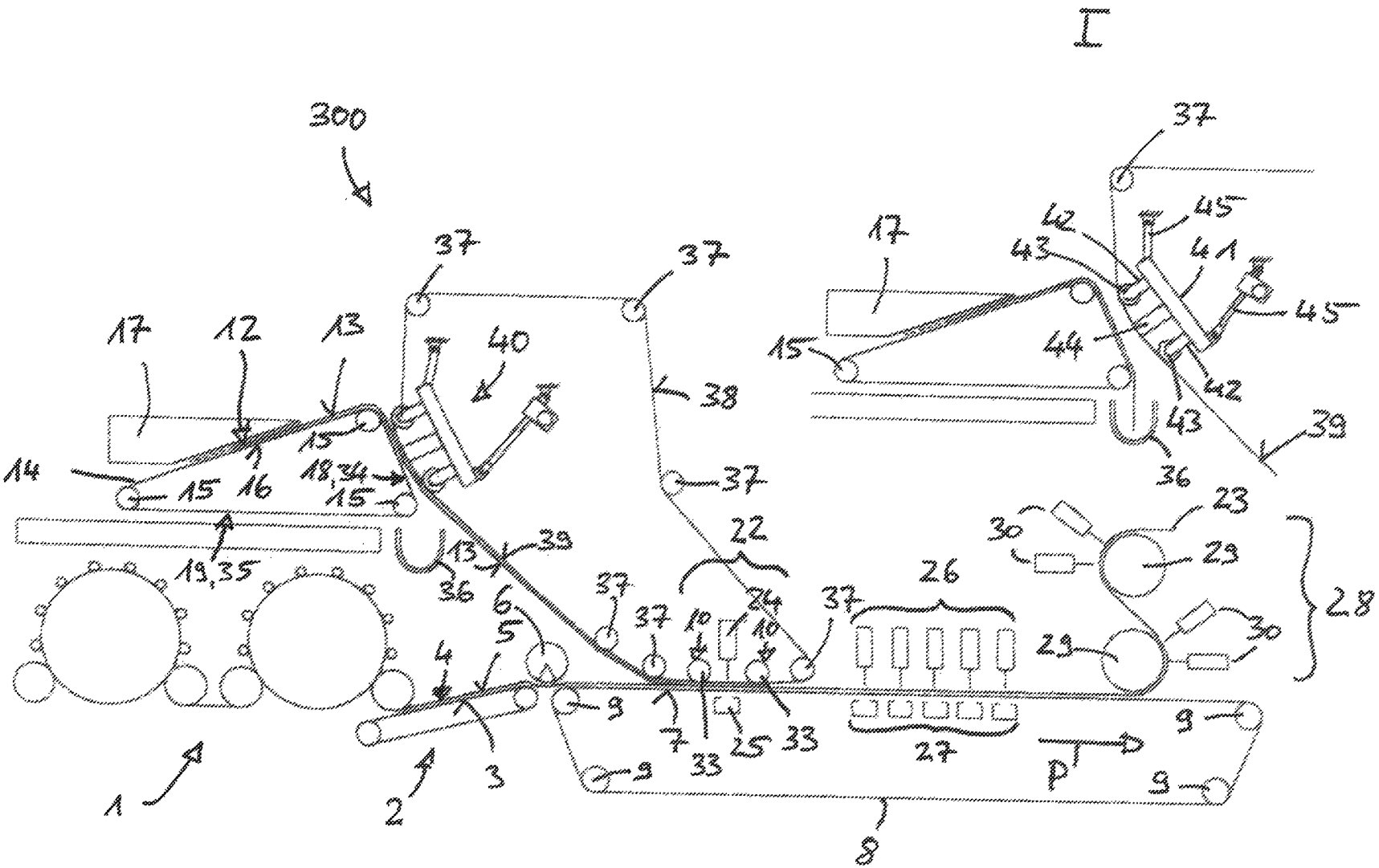
FIG. 3 is a third embodiment in the transfer position and partially in the rest position.

FIG. 2 shows the same system with a second embodiment of the device according to the present invention (device 200). Only the differences from the device 100 are therefore described below. In order to avoid repetition, reference is otherwise made to the explanations regarding device 100, which also apply to device 200.

Instead of the lower rollers 21, device 200 comprises the lower rollers 31, which are at a greater distance from one another in the direction of production P and also from the upper strand 7 of the first circulating belt 8 than the lower rollers 21. The lower rollers 31 are not part of the pre-bonding unit 22. The pre-bonding unit 22 is formed in the device 200 by two pressure bars 32 arranged parallel to one another and perpendicular to the direction of production P, which are arranged in the device 100 corresponding to the lower rollers 21 and replace their function in the pre-bonding unit 22. The pressure bars 32 can be provided with plastic caps or with ceramic coatings in the regions in which they come into contact with the circulating depositing belt 14 in order to reduce the friction with the depositing belt 14.

Figure 4:
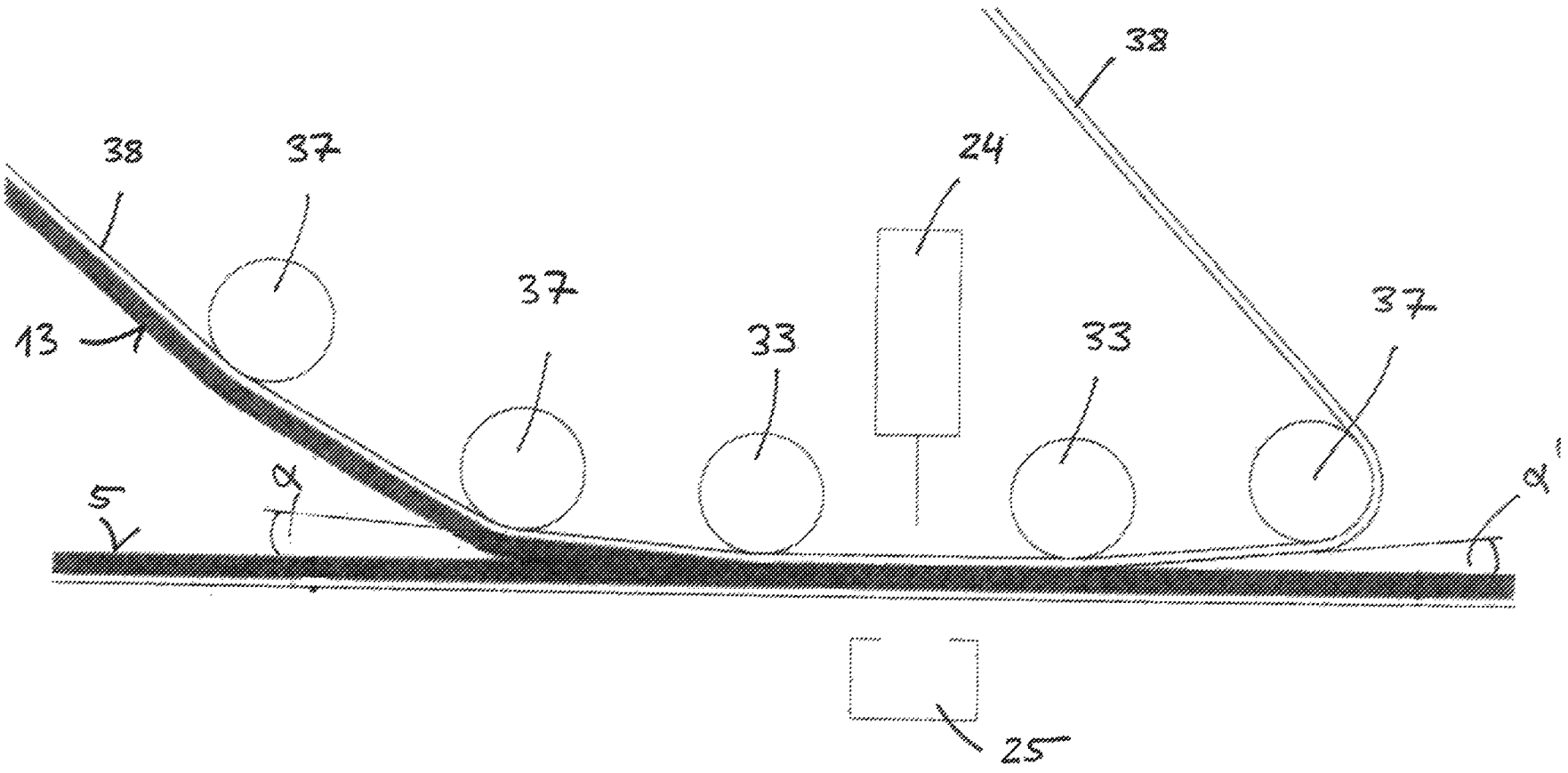
FIG. 4 shows detail IV from FIG. 3.

Since the lower rollers 31 are arranged at a greater distance from the upper strand 7, the depositing belt 14 runs between the lower rollers 31 and the respective pressure bar, forming angles $\alpha$, $\alpha'$, which can in particular be between 1° and 10°, as illustrated in FIG. 4 in connection with the third embodiment of the device according to the present invention (device 300). The size of the entry angle $\alpha$ is more relevant for the production result than the size of the exit angle $\alpha'$ so that the entry angle $\alpha$ can also be made considerably larger up to values greater than 90°.

Only the differences between device 300 and device 200 are described below. In this respect, in order to avoid repetition, reference is made to the explanations regarding device 200 and furthermore regarding device 100.

In device 300, the two pressure bars 32 are replaced by pressure rollers 33. This configuration is in particular recommended if the pre-bonding unit 22 is intended to apply higher pressure for compaction purposes since this can lead to an undesirable increase in the friction between the pressure bar 32 and the depositing belt 14 in the device 200.

Figure 5:
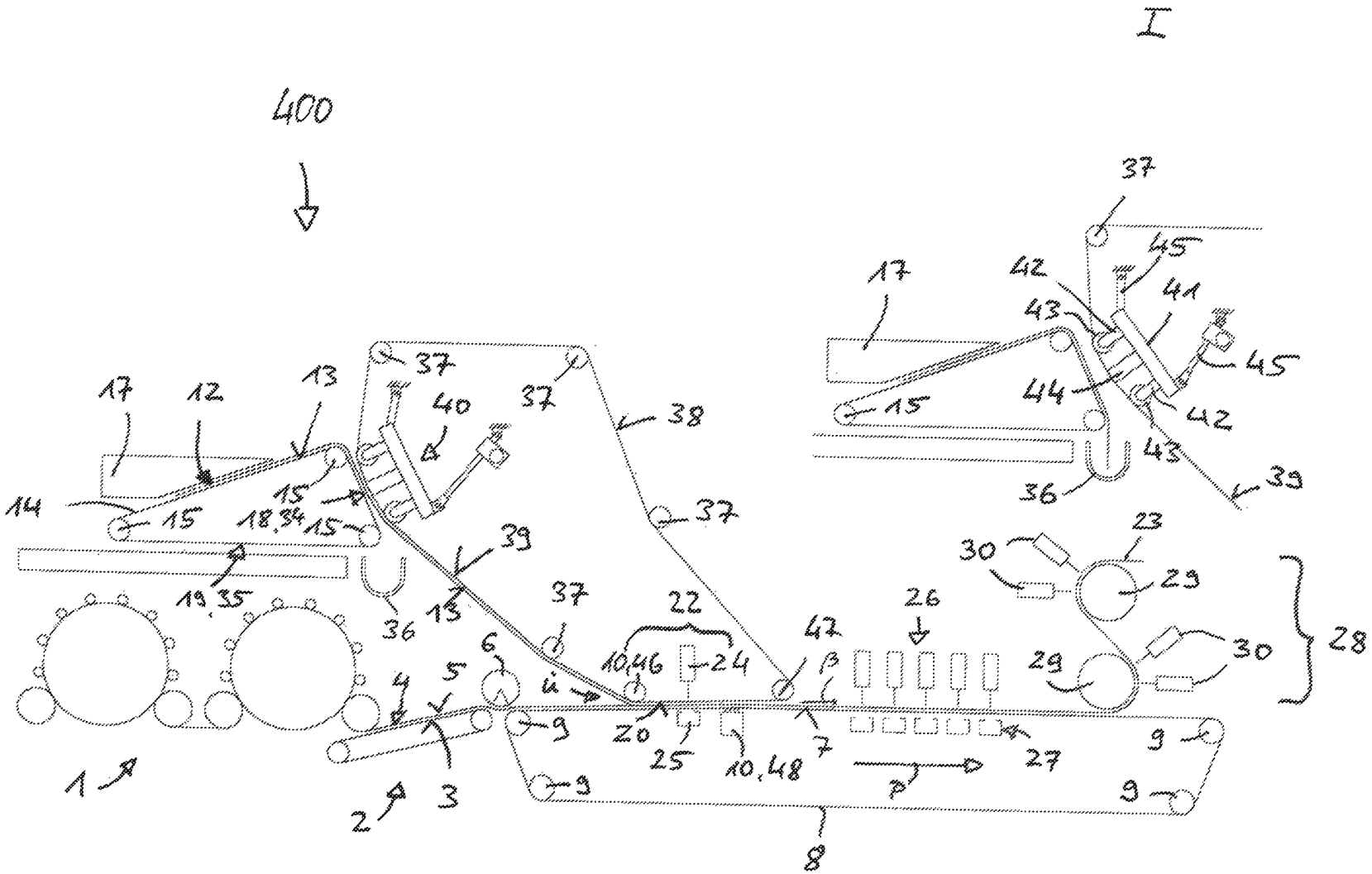
FIG. 5 is a fourth embodiment of the system according to the present invention.

The system shown in FIG. 5 for producing a nonwoven web 23, which can in particular have a basis weight between 20 and 150 grams per square centimeter, in particular between 40 and 70 grams per square centimeter, comprises a fourth embodiment of a device (device 400) for providing a layer 13 of fibers 12, in particular short fibers 12 with an average length of between 1 mm and 10 mm and, for example, a basis weight of between 5 and 50 grams per square meter, the structure and function of which is described in detail below.

The system also includes a carding unit 1, with which a layer 5 of long fibers 4, in particular a length between 10 mm and 150 mm and, for example, a basis weight between 15 and 50 grams per square centimeter, can be produced.

The carding unit 1 comprises a circulating depositing belt 2 with an upper strand 3 on which the long fibers 4 can be deposited to form the layer 13.

The system also includes a suction roller 6 with which the layer 5 can be transferred to an upper strand 7 of a first circulating belt 8 circulating around rollers 9 in a clockwise direction. The upper strand 7 moves in the direction of the arrow drawn in the figures, which thus symbolizes the direction of production P.

The first circulating belt 8 is designed to be permeable to liquids and gases, for example, as a screen belt.

The device 400 for providing the layer 13 of short fibers 12 comprises a depositing belt 14 which runs around rollers 15 in a clockwise direction.

The depositing belt 14 is in turn designed to be permeable to liquids and gases, for example, as a screen belt. Due to the arrangement of the rollers 15, the depositing belt forms a region 16 that ascends, when viewed in the direction of rotation, and in which the short fibers 12 are deposited from a headbox 17, for example, as an aqueous emulsion, to form the layer 13.

The depositing belt 14 also includes a region 18 which slopes obliquely downward in the direction of rotation and which forms a delivery strand 34. The depositing belt 14 is guided over a subsequent roller 15 in a horizontal region 19 which forms a return strand 35.

A fiber-collecting device 36 is arranged below the roller 15, on which the delivery strand 34 merges into the return strand 35.

The device 400 also comprises a transfer belt 38 which runs counterclockwise around upper rollers 37 and lower rollers 21 and has a receiving strand 39. A device 40 is provided within the space delimited by the transfer belt 38, with which the receiving strand 39 is moved between a transfer position in which a portion of the receiving strand 39 is at least almost in contact with the delivery strand 34 of the depositing belt 14 and at least a substantial proportion of the short fibers 12 of the layer 13 is transferred from the delivery strand 34 to the receiving strand 39, and a rest position in which the receiving strand 39 is spaced from the delivery strand 34 and at least a substantial proportion of the fibers is not transferred to the receiving strand. In FIG. 5, the rest position is illustrated in detail I.

The device 40 comprises a support structure 41 on which two guides 42 are arranged which are spaced apart from one another in relation to the direction of rotation of the transfer belt 38. They each include a roller 43 which comes in contact with the receiving strand 39 of the transfer belt 38 from the inside. As seen in the direction of rotation of the transfer belt 38, a selectively activatable suction device 44 is arranged between the guides 42 via which air can be sucked through the transfer belt 38, thereby making it possible to suction the short fibers 12 or the layer 13 onto the transfer belt 38.

The support structure 41 is linked to a machine frame (which is not shown in the drawing) via linkage units 45, at least one of which is variable in length so that the device 40 can be displaced between a position at which the transfer belt 38 is in the transfer position and a position at which the transfer belt 38 is in the rest position.

As can be seen in detail I, the short fibers 12 forming the layer 13 are not transferred to the transfer belt 38 in the rest position, but instead pass from the delivery strand 34 of the depositing belt 14 to the fiber-collecting device 36.

If the receiving strand 39 is in the transfer position, the short fibers 12, by coming into contact with the receiving strand 39, reach the transfer belt 38, if necessary, supported by the action of the suction device 44. From the transfer belt 38, the short fibers 12 or the layer 13 reach a lower strand 20 of the transfer belt 38, which is formed between a first lower roller 46 in the direction of production P and a second lower roller 47 in the direction of production P.

In the system shown in FIG. 5, the first lower roller 46 forms a compacting device 10 and is part of a pre-bonding unit 22. During the operation of the system, the first lower roller 46 is in a position relative to the upper strand of the first circulating belt 8 in which the distance between the lower strand 20 of the transfer belt 38 and the upper strand 7 of the first circulating belt 8 is smaller than the sum of the thicknesses of layers 5 and 13.

Another compacting device 10', which is also part of the pre-bonding unit 22, forms a suction chamber 48. It extends parallel to the first lower roller 46 approximately across at least the width of the first circulating belt 8. The suction chamber 48 comprises upper, flat contact surfaces 49 on which the upper strand 7 of the first circulating belt 8 rests with its underside. The suction chamber 48 comprises one or more suction openings 50 between the contact surfaces 49. The suction chamber 48 is arranged so that the first circulating belt 8 is pushed upwards by the suction chamber so that the upper strand 7 runs parallel to the lower strand 20 of the transfer belt 38 between the first lower roller 46 and the suction chamber 48. The pre-bonding unit 22 thus extends in the device 400 between the first lower roller 46 and the suction chamber 48.

The first circulating belt 8 and the transfer belt 38 can also contact each other in the region of the pre-bonding unit 22; in other words, the distance can assume the value zero if no layer passes through the pre-bonding unit 22. When passing through one or more layers, the belts 8 and 38 can assume a distance again due to the flexibility of the first circulating belt 8 without a displacement of the pre-bonding unit 22 being absolutely necessary for this purpose.

As seen in the direction of production P behind the suction chamber 48, the first circulating belt 8 declines from the lower strand 20 of the transfer belt 38. In the direction of production, the distance between the first circulating belt 8 and the transfer belt 38 thus increases behind the suction chamber 48 before the transfer belt 38 is deflected upwards around the second lower roller 31.

Figure 6:
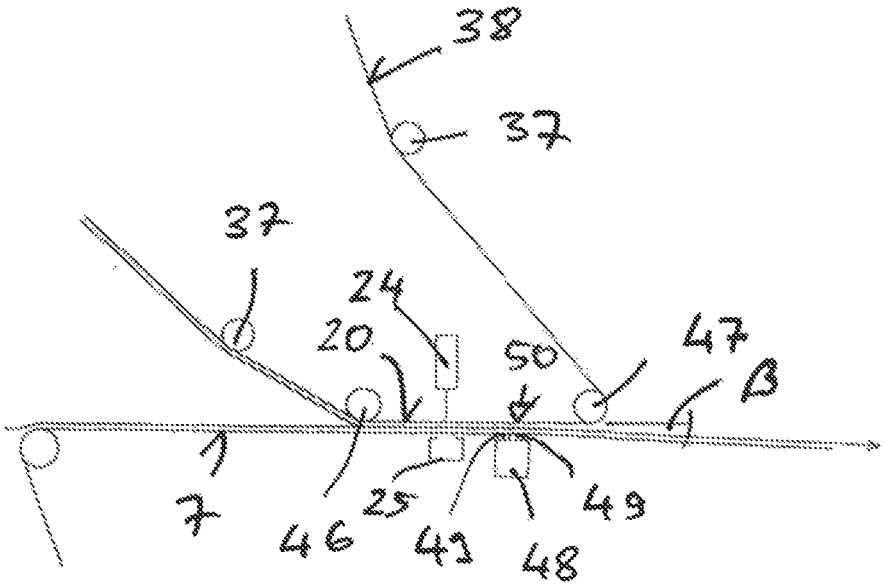
FIG. 6 is a partial view of a first pre-bonding unit (detail VI in FIG. 5) of the fourth embodiment.

This first embodiment of the pre-bonding unit 22 is shown separately in FIG. 6.

The layer 13 is transferred to the layer 5 at a transfer point Ü, which is located in the direction of production P in front of the first lower roller 46 shown in the drawing on the left. Since the distance between the upper strand 7 and the lower strand 20 is smaller than the sum of the thicknesses of the two layers 5 and 13, the two layers undergo a first flat compaction in the region between the first lower roller 46 and the suction chamber 48 in the process of becoming a nonwoven web 23. The size of the region depends on the distance between the first lower roller 46 and the suction chamber 48 in the direction of production P.

To provide that the desired compaction can take place, the first circulating belt 8 and the transfer belt 38 must rotate at identical speeds so that no friction occurs during compaction, which could adversely affect the compaction process.

Experiments have surprisingly shown that the risk of layer 13 adhering to the transfer belt 38 behind the pre-bonding unit 22 in an undesirable manner is reduced if the pre-bonding unit 22 is limited in the direction of production P by two compacting devices 10, 10', the first of which acts on the transfer belt 38 and the second of which acts on the first circulating belt 8 so that the first circulating belt 8 undergoes a change in direction at an angle $\beta$ of at least 1° when passing through the further compacting device 10'. In the case of the device 400, the risk of adhesion is further reduced in that the further compacting device 10' is designed as a suction chamber 48, to which negative pressure is applied during operation of the device 400, which causes an air flow to be generated through the first circulating belt 8 which prevents a detachment of the layer 13 supported by the transfer belt 38.

To provide that the two layers 5, 13 have sufficient strength after leaving the region between the upper strand 7 and the lower strand 20 for the further processing steps necessary to form the nonwoven web, the pre-bonding unit 22 comprises a clamping unit in the direction of production P between the two lower rollers 46, 47 and within the nozzle bar 24 arranged within the transfer belt 38, which forms a bonding device 28, and a collecting device 25, which is arranged at a corresponding point in the direction of production within the first circulating belt 8, which can comprise a suction box. On its side facing the lower strand 20, the nozzle bar 24 comprises a plurality of nozzles, from which jets of water exit under pressure during the operation of the system 1, causing the two layers 5 and 13 to bond as they are swirled by the lower strand 20 of the transfer belt 38. The collecting device 25 is used to collect at least part of the water discharged from the nozzle bar 24, which can then be returned to the production process, possibly after treatment.

Due to the arrangement of the bonding device 28 between the compacting devices 10, 10' and the associated simultaneous bonding due to the compaction, a recovery of the layer comprising long fibers 4 is avoided so that the use of the system according to the present invention or the application of the method according to the present invention substantially reduces the risk of defectively formed nonwoven webs with two layers.

For further bonding and compaction purposes, a plurality of nozzle bars 26 and collecting devices 27 are provided outside of the depositing belt 14 in order to additionally bond the layers 5 and 13 from above.

A further bonding device 28 is provided downstream in the direction of production P. It comprises two bonding drums 29 which, during operation, are rotated by the layers 5 and 13 so that each of the two layers is in contact with one of the two bonding drums 29 over an angular range of approximately 120°. Two additional nozzle bars 30 are provided for each bonding drum 29 and act in a region in which the layers 5, 13 are in contact with the bonding drums 29.

The bonding drums 29 each have a gas- and liquid-permeable lateral surface so that at least part of the water discharged from the nozzle bars 30 during operation can be suctioned by the bonding drums and also, possibly after treatment, can be returned to the production process. The bonding device 28 is used for further bonding of the two layers 5 and 13 to form the nonwoven web 23, which can be fed to further processing steps after having passed through the bonding device.

Figure 7:
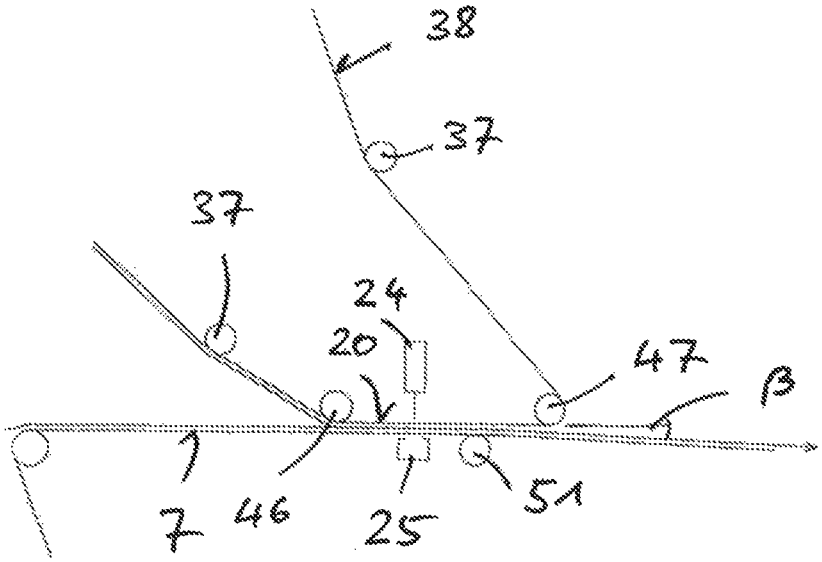
FIG. 7 is a partial illustration corresponding to FIG. 6 of a second pre-bonding unit.

A second embodiment of a pre-bonding unit 22 of the fourth embodiment of the device 400 is shown in FIG. 7. In order to avoid repetition, only the differences from the first embodiment of the pre-bonding unit 22 will be described. Like reference signs thereby denote like components.

In the second embodiment of the pre-bonding unit 22, a pressure roller 51 is provided, instead of the suction chamber 48, which is aligned parallel to the first lower roller 46, and which extends across the entire width of the first circulating belt 8 and presses against its upper strand 7 from below, analogous to the suction chamber 48 in the first embodiment of the pre-bonding unit 22.

In this second embodiment, a detachment of the layer 13 from the transfer belt 38 in the direction of production P behind the pressure roller 51 is supported solely by the change in direction that the first circulating belt 8 experiences when passing through the pressure roller 51. If necessary, the pressure roller 51 can be designed as a suction roller, which can be subjected to a negative pressure in order to generate an air flow through the first belt 8 that is directed towards the surface of the suction roller.

Figure 8:
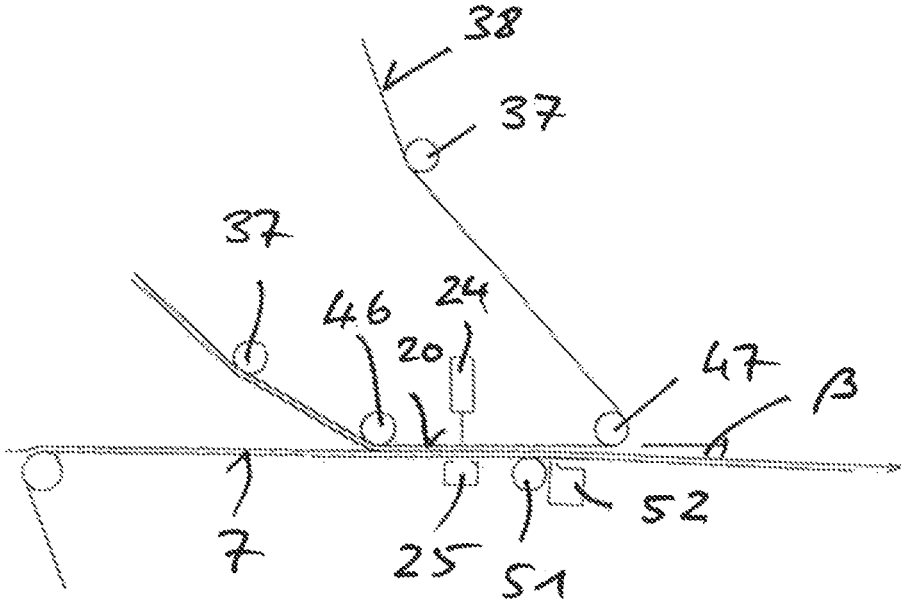
FIG. 8 is a partial illustration corresponding to FIG. 6 of a third pre-bonding unit.

A third embodiment of a pre-bonding unit 22 of the fourth embodiment of the device 400 is shown in FIG. 8. In order to avoid repetition, only the differences from the second embodiment of the pre-bonding unit will be described. Like reference thereby signs denote like components.

In the third embodiment of the pre-bonding unit 22, a pressure roller 51 is again provided which is aligned parallel to the first lower roller 46 across the entire width of the first circulating belt 8 and presses against its upper strand 7 from below. A suction chamber 52 is provided immediately behind this pressure roller 51 in the direction of production which does not bear against the upper strand 7 of the first circulating belt 8 from below, but generates an air flow from the top to the bottom through the first circulating belt 8 by applying negative pressure and thus supporting the detachment of the layer 13 from the transfer belt 38. For this purpose, the suction chamber 52 has a suction opening 53 which, seen in the direction of production P, is adjacent to the pressure roller 51.

In this third embodiment, a detachment of the layer 13 from the transfer belt 38 in the direction of production P behind the pressure roller 51 is supported not solely by the change in direction that the first circulating belt 8 experiences when passing through the pressure roller 51, but by the suction chamber 52. Since the first circulating belt 8 is not in contact with the suction chamber, but only with the co-rotating pressure roller 51, the friction acting on the first circulating belt 8 is reduced in comparison to the first embodiment of the pre-bonding unit 22.

Figure 9:
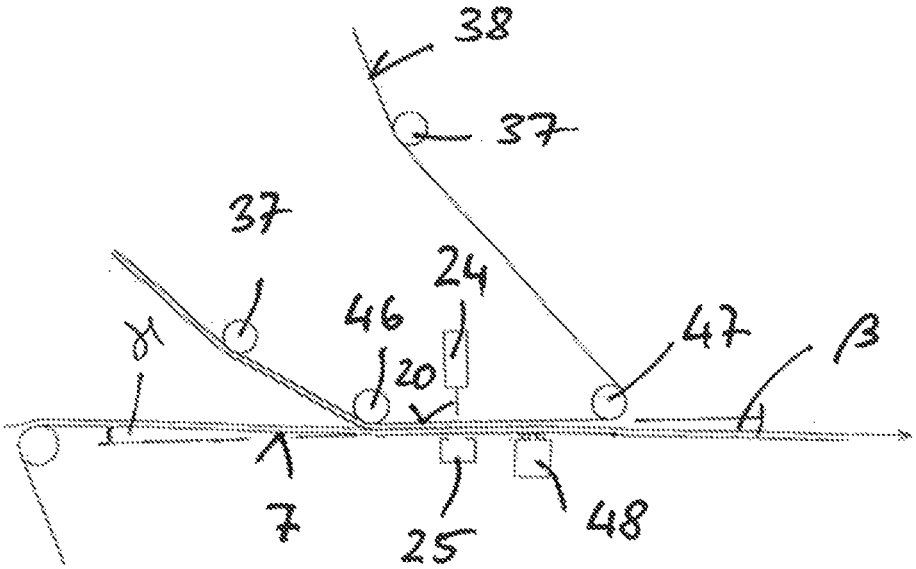
FIG. 9 is a partial illustration corresponding to FIG. 6 of the first pre-bonding unit with a modified guidance of the upper strand of the first circulating belt.

FIG. 9 shows the first embodiment of a pre-bonding unit 22 of the fourth embodiment of the device 400 with a modified guidance of the upper strand 7 of the first circulating belt 8. In order to avoid repetition, only the differences from the guide shown in FIG. 6 will be described. Like reference signs thereby denote like components.

In the guidance of the upper strand 7 of the first circulating belt 8 shown in FIG. 6, the first circulating belt 8 does not change direction when it passes through the first lower roller 46. In order to increase the compacting effect of the first lower roller 46, the first circulating belt 8 is guided in the guidance shown in FIG. 9 so that the upper strand 7 of the first circulating belt 8 is pressed against the transfer belt 38 in the region of the first lower roller 46 and thus experiences a change in direction by a small angle λ which is caused by the action of the first lower roller 46.

In the three embodiments of the device according to the present invention described above, a carding unit 1 serves to provide the layer 5 comprising long fibers 4. It goes without saying that not only a carding unit 1 can be used to provide such a layer, but also other devices with which a layer comprising long fibers 4 can be produced inline. In addition, the layer can also be provided separately, i.e., produced offline and wound up into a roll. In such a case, for example, an unwinding station is provided instead of the carding unit 1. It is also possible to use the device according to the present invention for providing fibers in a system in which only these fibers are processed into a nonwoven web or in systems that serve to produce underlying webs.

The present invention is not limited to embodiments described herein; reference should be had to the appended claims.

LIST OF REFERENCE SIGNS

100 Device
200 Device
300 Device
400 Device
1 Carding unit
2 Depositing belt
3 Upper strand
4 Long fibers
5 Layer
6 Suction roller
7 Upper strand
8 First circulating belt
9 Roller
10, 10' Compacting devices
12 Short fibers
13 Layer
14 Depositing belt
15 Roller
16 Region
17 Headbox
18 Region
19 Horizontal region
20 Lower strand
21,21' Lower rollers
22 Pre-bonding unit
23 Nonwoven web
24 Nozzle bar
25 Collection device
26 Nozzle bar

27 Collection devices
28 Bonding device
29 Bonding drum
30 Nozzle bar
31 Lower rollers
32 Pressure bar
33 Pressure rollers
34 Delivery strand
35 Return strand
36 Fiber collection device
37 Upper rollers
38 Transfer belt
39 Receiving strand
40 Device
41 Support structure
42 Guide
43 Roller
44 Suction device
45 Linkage units
46 First lower roller
47 Second lower roller
48 Suction chamber
49 Contact surfaces
50 Suction opening
51 Pressure roller
52 Suction chamber
53 Suction opening
A Distance
α Angle/Entry angle
α' Angle/Exit angle
β Angle
D Diameter
λ Small angle
P Direction of production
Ü Transfer point

What is claimed is:

1. A system for bonding a first layer comprising short fibers with a second layer comprising long fibers to form a nonwoven web, the system comprising:

a circulating belt which is configured to have the second layer comprising the long fibers be placed and displaced thereon in a direction of production;

a headbox;

a circulating depositing belt comprising a delivery strand, the circulating depositing belt being configured to have the short fibers be deposited thereon so that, together with the headbox, the first layer is formed;

a circulating transfer belt comprising a receiving strand, the circulating transfer belt being configured so that the first layer comprising the short fibers can be transferred at a transfer point to the second layer comprising the long fibers;

a device that is operatively connected to the delivery strand or to the receiving strand so that the delivery strand or the receiving strand are displaced between a transfer position, in which at least a substantial proportion of the short fibers are transferred from the delivery strand to the receiving strand and conveyed onward by the circulating transfer belt, and a rest position of the short fibers, in which the delivery strand and the receiving strand are spaced apart and at least the substantial proportion of the short fibers is not transferred to the receiving strand, but is conveyed on by the circulating depositing belt;

a pre-bonding unit comprising a first compacting device and a second compacting device which are spaced apart from one another in the direction of production, the first compacting device and the second compacting device being configured to act on the circulating transfer belt in a region so as to form a lower strand of the circulating transfer belt between the first compacting device and the second compacting device; and a bonding device arranged between first compacting device and the second compacting device in the direction of production, the bonding device being configured to bond the first layer and the second layer together by swirling the short fibers and the long fibers;

wherein, the first compacting device, the second compacting device and the bonding device are operatively connected to one another so that they are each always either in an operating state or in a resting state.

2. The system as recited in claim 1, wherein the first compacting device and the second compacting device each comprise a pressure roller.

3. The system as recited in claim 1, wherein the first compacting device and the second compacting device each comprise a pressure bar.

4. The system as recited in claim 1, further comprising:

at least one lower roller, wherein, when viewed in the direction of production, at least one of, the at least one lower roller is arranged in front of the pre-bonding unit so as to be circulated by the circulating belt, and the at least one lower roller is arranged behind the pre-bonding unit so as to be circulated by the circulating transfer belt.

5. The apparatus as recited in claim 4, wherein, two of the at least one lower roller is provided, and the two lower rollers are arranged so that the circulating depositing belt has, with regard to the circulating belt between the two lower rollers and the respectively adjacent first compacting device, an entry angle of between 1° and 10° and an outlet angle of greater than 1°.

6. The system as recited in claim 1, wherein the first compacting device, when viewed in the direction of production from above against the lower strand of the circulating transfer belt, and the second compacting device, when viewed in the direction of production from below against the upper strand of the circulating belt, acts so that the circulating belt undergoes a change in direction by an angle when passing through the second compacting device.

7. The system as recited in claim 6, wherein the first compacting device comprises a first lower roller.

8. The system as recited in claim 6, wherein the second compacting device comprises a suction chamber.

9. The system as recited in claim 8, wherein the suction chamber comprises at least one contact surface for the circulating belt.

10. The system as recited in claim 9, wherein the suction chamber comprises a suction opening.

11. The system as recited in claim 6, further comprising:

a suction chamber, wherein, the second compacting device comprises a pressure roller, and the suction chamber is arranged in the direction of production immediately behind the pressure roller.

12. The system as recited in claim 1, wherein the bonding device comprises a nozzle bar which is arranged inside the circulating transfer belt.

13. The system as recited in claim 1, wherein the device comprises a first guide and a second guide which are arranged in a region of the receiving strand and which are spaced apart from one another in a circumferential direction of the circulating transfer belt, the first guide and the second guide being configured to rest against or to be brought into contact with the circulating transfer belt and to be displaceable with a movement component which is perpendicular to the receiving strand.

14. The system as recited in claim 13, wherein the device further comprises a suction device which is configured to be activated as desired, the suction device being configured to suction the circulating transfer belt in the region of the receiving strand.

15. The system as recited in claim 14, wherein the suction device is arranged in a circumferential direction between the first guide and the second guide.

16. The system as recited in claim 13, wherein the device further comprises a support structure which is arranged to at least one of be movable and pivotable by a motor in parallel to the receiving strand.

17. The system as recited in claim 1, further comprising:

a fiber-collecting device which is configured to collect the short fibers that were not transferred to the receiving strand.

18. The system as recited in claim 17, further comprising:

a return strand, wherein, the circulating depositing belt further comprises a deflection roller which is configured to deflect the delivery strand into the return strand, and the fiber-collecting device is arranged under the deflection roller.

* * * * *